US009392822B2

(12) United States Patent
McKeen

(10) Patent No.: US 9,392,822 B2
(45) Date of Patent: Jul. 19, 2016

(54) SUPPORT BUSTIER GARMENT

(71) Applicant: EVELYN & BOBBIE, LLC, Portland, OR (US)

(72) Inventor: Bree McKeen, Portland, OR (US)

(73) Assignee: Evelyn & Bobbie, Portland, OR (US)

( * ) Notice: Subject to any disclaimer, the term of this patent is extended or adjusted under 35 U.S.C. 154(b) by 0 days.

(21) Appl. No.: 14/833,669

(22) Filed: Aug. 24, 2015

(65) Prior Publication Data

US 2015/0359268 A1 Dec. 17, 2015

Related U.S. Application Data

(63) Continuation of application No. 14/517,743, filed on Oct. 17, 2014, now Pat. No. 9,237,772, which is a continuation of application No. 14/165,271, filed on Jan. 27, 2014, now Pat. No. 8,864,549.

(60) Provisional application No. 61/756,989, filed on Jan. 25, 2013.

(51) Int. Cl.

| | |
|---|---|
| ***A41C 3/10*** | (2006.01) |
| ***A41C 3/12*** | (2006.01) |
| ***A41C 3/14*** | (2006.01) |

(52) U.S. Cl.

CPC . *A41C 3/10* (2013.01); *A41C 3/122* (2013.01); *A41C 3/142* (2013.01)

(58) Field of Classification Search

CPC ..... A41C 3/00; A41C 3/007; A41C 3/0014; A41C 3/10; A41C 3/12; A41C 3/122; A41C 3/128; A41C 3/14; A41C 1/00; A41C 1/006

USPC ..... 450/7, 8, 41–49, 51–53, 56

See application file for complete search history.

(56) References Cited

U.S. PATENT DOCUMENTS

| | | | | |
|---|---|---|---|---|
| 2,553,036 A | | 5/1951 | Christensen | |
| 2,786,205 A | | 3/1957 | Payne | |
| 2,992,646 A | * | 7/1961 | Weinberg | A41C 3/0007 450/41 |
| 2,994,325 A | | 8/1961 | Geissmann | |
| 3,196,460 A | | 7/1965 | Marian | |

(Continued)

OTHER PUBLICATIONS

Babej, "Does Silent Assembly's New Bra Technology Spell The End of The Underwire?", Forbes (Aug. 15, 2013), http://www.forbes.com/sites/marcbabej/2013/08/15/does-silent-assemblys-new-bra-technology-spell-the-end-of-the-underwire/, 4 pgs.

(Continued)

*Primary Examiner* — Gloria Hale

(74) *Attorney, Agent, or Firm* — Ascenda Law Group, PC

(57) ABSTRACT

A bustier garment may have first and second support structures that are housed within a housing. The first and second support structures may be positioned within the housing such that each of the respective support structures correspond to a position between a center and a bottom of a wearer's first and second respective breasts when the bustier garment is worn by a wearer. In one embodiment, the bustier garment may include first and second support structures that are positioned and oriented within a housing such that the respective first and second support structures are substantially perpendicular to a vertical midline of the garment and/or substantially parallel to a lower edge of the garment.

26 Claims, 16 Drawing Sheets

(56) References Cited

U.S. PATENT DOCUMENTS

| | | | | |
|---|---|---|---|---|
| 3,351,954 | A | 11/1967 | Chalfin et al. | |
| 3,491,762 | A | 1/1970 | Simonsen | |
| 3,698,399 | A | 10/1972 | Hand | |
| 6,165,045 | A | 12/2000 | Miller et al. | |
| 6,379,327 | B2 | 4/2002 | Lundy | |
| 6,431,946 | B1 | 8/2002 | Fildan et al. | |
| 6,439,959 | B1 * | 8/2002 | Magrone | A41C 3/0014 450/41 |
| 6,447,365 | B1 | 9/2002 | Powell et al. | |
| 6,761,614 | B2 | 7/2004 | Pinna | |
| 7,234,994 | B2 | 6/2007 | Fildan et al. | |
| 7,309,276 | B2 | 12/2007 | Legaspi et al. | |
| 7,377,833 | B1 | 5/2008 | Wanzenboeck et al. | |
| 7,407,428 | B2 | 8/2008 | Fildan et al. | |
| 7,425,170 | B1 | 9/2008 | Herbert et al. | |
| 7,549,302 | B2 | 6/2009 | Duckham et al. | |
| D606,285 | S | 12/2009 | Schindler | |
| D616,627 | S | 6/2010 | Schindler | |
| D622,477 | S | 8/2010 | Schindler | |
| 7,833,082 | B2 | 11/2010 | Bugada | |
| 8,047,891 | B1 | 11/2011 | Albritton | |
| 8,123,589 | B2 | 2/2012 | Chapman et al. | |
| 8,187,054 | B2 | 5/2012 | Redenius | |
| D666,384 | S | 9/2012 | Schindler | |
| 8,864,549 | B2 * | 10/2014 | McKeen | A41C 3/10 450/41 |
| 9,237,772 | B2 * | 1/2016 | McKeen | A41C 3/10 |
| 2008/0090491 | A1 | 4/2008 | Liu | |
| 2010/0120329 | A1 | 5/2010 | MacDonald | |
| 2011/0244757 | A1 | 10/2011 | Mays | |
| 2015/0044940 | A1 * | 2/2015 | McKeen | A41C 3/10 450/1 |

OTHER PUBLICATIONS

Bellis, "The History of the Brassiere", About.com, http://inventors.about.com/od/bstartinventions/a/brassiere.htm; downloaded Jun. 30, 2014, 1 pg.

"Customer Service: Patent Information", Jockey bra, http://www.jockey.com/customerservice/patentsinformation, downloaded Jun. 30, 2014, 2 pg.

Evelyn & Bobbie, LLC; International Application No. PCT/US2014/013240 filed Jan. 27, 2014 International Search Report and Written Opinion dated May 21, 2014, 12 pgs.

JoViPak, http://www.bellisse.com/index.php?option=com_content& view=category&layout=blog&id=58&Itemid=27; downloaded Jun. 30, 2014; 2 pgs.

Kenosha, "New Jockey® bra, with Patented Volumetric Fit System, Gives Women a Near-Custom Fit", Jockey bra (May 30, 2013), http://smnr.akamediainc.com/jockey-reinvents-the-bra/, 2 pgs.

Pop, Lenuta, "Here comes the bra technology Microsoft", ICGEEKS (Dec. 4, 2013), http://icgeeks.org/here-comes-the-bra-technology-microsoft/, 3 pgs.

Riordan, "Patents; In bra technology, an incremental improvement can translate into comfort", The New York Time (Oct. 28, 2002), http://www.nytimes.com/2002/10/28/business/patents-in-bra-technology-an-incremental-improvement-can-translate-into-comfort.html, 2 pgs.

The Emergency Bra website: http://ebbra.com/; downloaded Jun. 30, 2014; 1 pg.

Thirdlove website: https://thirdlove.com., accessed Jun. 30, 2014; 2 pgs.

Ultimo website, http://www.ultimo.co.uk/michelle-mone; downloaded Jun. 30, 2014; 2 pgs.

* cited by examiner

SUPPORT BUSTIER GARMENT

RELATED APPLICATION

This application is CONTINUATION of U.S. patent application Ser. No. 14/517,743, now U.S. Pat. No. 9,113,662 9,237,772 entitled "Support Bustier Garment" filed on Oct. 17, 2014, which is a CONTINUATION of U.S. patent application Ser. No. 14/165,271, now U.S. Pat. No. 8,864,549, entitled "Support Bustier Garment" filed on Jan. 27, 2014, which is a NON-PROVISIONAL of U.S. patent application Ser. No. 61/756,989 filed Jan. 25, 2013, all of which are incorporated herein by reference.

FIELD OF INVENTION

The present invention relates to the field of apparel and, more specifically to a support bustier garment. The support bustier garment may be configured to reposition a portion of a volume of the wearer's respective breast and support a portion of a weight of the wearer's respective breast when worn by the wearer.

BACKGROUND

Brassieres have been used for lifting and shaping the breasts for approximately 100 years. Brassieres (and other related garments, such as underwire swimwear tops) are typically manufactured using two U-shaped metal components or "underwires," which serve to create a rounded housing for each breast. The underwire also serves to create a uniform shape in accordance with a fashionable silhouette. The underwire is conventionally a flat U-shape, and does not conform to the curved dimensions of the wearer's rib cage. Thus, the underwire brassiere in its traditional form frequently creates areas of poking and rubbing at the ends of the wire (between breasts and in underarm areas), as well as pinching at the lowermost point of the underwire (at the bottom of the breast, directly under the nipple) where the underwire pushes into the ribs. The larger the breasts, the more significant these pressure points tend to be. Seams and fabric casements, which serve to hold the underwire in place, can further exacerbate the pinching and rubbing of the wire against the skin and ribs.

The underwire casement of traditional brassieres typically attaches to three straps. The primary back strap attaches laterally around the rib cage, in most cases fastening in the rear near the spine. The two shoulder straps attach to the underwire casement in the front and to the lateral strap in the rear. The two shoulder straps run over the belly of the trapezius muscles and support the weight of the breasts against these muscles of the neck and shoulders (primarily the trapezius and levator scapulae muscles). In this way, the force of the lifted breast effectively hangs from the neck and shoulders.

In typical brassiere construction, and especially in larger breasted wearers, all three straps typically create discomfort for the wearer. To support the load of the breast tissue, conventional shoulder straps push down on the trapezius muscles, which in turn forces the head forward and the spine out of proper postural alignment. This misalignment frequently results in tension in the head, neck and shoulders that is directly linked to wearing a conventional bra. This pressure on the trapezius muscles is made visible in the surface indentations frequently left behind in the shoulders of brassiere wearers. Further, these indentations frequently become permanent after years of continued brassiere wear. The effects can also be seen in the slouched or hunched spinal posture of large-breasted, brassiere-wearing women.

In addition, if the primary back strap is fitted tightly enough to the torso such to relieve some of the pressure from the shoulder straps, then the pressure of the underwire casement against the body (and the rubbing and pinching related to the casement) in turn increases. In the case of brassiere garments where the shoulder straps have been removed entirely (i.e. "strapless" brassieres), the garment typically slides down the torso over time, moving out of its intended placement and flattening the profile of the breasts, with aesthetically displeasing results. The result is that wearers are forced to frequently tug the garment back into place, undermining the intention of the wearer for the state of their undergarment to remain private. (Imagine, by way of example, a bride with a strapless dress and strapless brassiere, which begins to fall down during her wedding ceremony. To remain modest and avoid embarrassment, she has no choice but to tug her undergarment back into place, thus revealing the state of her undergarment slippage to any who are observing her.)

In addition, underwire-alternative brassieres that possess rigid regions or thick seams directly beneath the breast fail to provide a comfortable alternative because of resulting pressure on the top of the abdominal cavity when the wearer sits or otherwise bends at the waist.

In summary, the traditional construction of the bra brings with it a set of specific design features that are inherently linked to chafing, rubbing, poking, and pinching of the skin; tension and pain in the muscles of the wearer; and pressure or compression of the upper abdominal cavity.

SUMMARY

Support bustier garments worn by a wearer having two breasts are herein described. The support bustier garment may include a set of two support structures and a housing. The support structures may be positioned within the housing such that each support structure corresponds to a position between a center and a bottom of the wearer's breast when the garment is worn by the wearer. On some occasions, the housing may include one or more attachment mechanisms (e.g., snap, tension and/or magnet closure) configured to removably attach to one or more embellishments, such as straps or a camisole.

The support structures may be curved to approximate a shape of a woman's breast. Each of the support structures may be configured to reposition a portion of a volume of one of the wearer's breasts (e.g., push breast tissue from an outside of a breast toward a midline of the wearer or lift a portion of the breast tissue from an original position to a higher position measured relative to the user's waist) when the garment is worn by a wearer. Stated differently, each support structure repositions a volume of a different one of the wearer's breasts. The support structures may also serve to shape the wearer's breasts. The support structures may be manufactured using, for example, a molding process, a cutting process, and/or a punch process. The support structure may be made from one material or may include a plurality of layers of material.

Each of the support structures may also be configured to support a portion of the weight of each of the wearer's breasts when worn by the wearer. Stated differently, each support structure supports a portion of the weight of a different one of the wearer's breasts. At times, the support structures may be configured to extend orthogonally from the plane of a torso of the wearer when the garment is worn by the wearer. The support structures may be self-supporting independently of the housing. Stated differently, the support structures may retain their shape, even when not worn, independently of the housing.

The support structure may be configured to exert a force opposing the portion of the weight of the wearer's breasts when the garment is worn by the wearer. For example, the support structure may be configured to apply a force substantially equal in magnitude and substantially opposite in direction to the weight of the wearer's breasts such that the weight of the wearer's breasts is supported and is at rest. At times, the force may be applied to the wearer's breast independently of the housing.

In some embodiments, each support structure may be configured to redistribute the portion of the weight of the wearer's breasts to the wearer's torso when the garment is worn by the wearer.

In some embodiments, the support structure may include one or more perforations. The perforations may be of any size and positioned anywhere within the support structure, provided the support structure maintains its structural integrality.

The housing of the garment may be coupled to the set of support structures and be configured to house the set of support structures and wrap around the wearer's chest, thereby enabling the wearer to wear the garment. The housing may be manufactured from, for example, fabric, plastic, elastic, fasteners, closure mechanisms, or any combination thereof. On some occasions, the housing may include decorative features (e.g., colors, printed on patterns, applied detailing, etc.).

In some embodiments, the garment may include a set of flexible structures positioned within the housing such that each flexible structure is coincident with one of the support structures of the set of two support structures. On some occasions, each of the flexible structures having a lower extension positioned within the housing so as to be coincident with a portion of a torso of the wearer located under the wearer's breast when the garment is worn by the wearer. In one embodiment, the lower extensions of the flexible structures may be coupled together, thereby forming a continuous band of the flexible structure under both breasts of the user. In this embodiment, the coupled flexible structures may extend to the sides of the wearer's torso and/or around the back of the wearer. In another embodiment, a width of the lower extension being proportional to the portion of the weight being supported by at least one of the support structure, the flexible structure, and a combination thereof. For example, when the amount of weight being supported by the support structures and flexible structures is relatively large, then the width of the lower extension may be relatively large, in proportion to the supported weight and, conversely, when the amount of weight being supported by the support structures and flexible structures is relatively small, then the width of the lower extension may be relatively small, in proportion to the supported weight.

In yet another embodiment, the garment may include a layer of flexible material coupled to each support structure and positioned within the housing. The layer of flexible material may be configured to conform to the shape of the wearer's breasts and support a portion of the weight of the wearer's breasts when worn by the wearer.

In a further embodiment, each of the support structures may include a band, an inner extension, and an outer extension. The band may extend between and be coupled to the inner and outer extensions and may be configured to correspond to a position between a center and a bottom of the wearer's breast. The band may extend in a direction substantially perpendicular to a midline of the wearer when the garment is worn by the wearer. In this way, the band may wrap around a portion of the wearer's breast.

The inner extension may be positioned at or near a midline of the wearer and extend above, below, and/or above and below the band, in a vertical direction substantially in parallel with the midline of the wearer when worn by the wearer. The outer extension may extend in a vertical direction substantially in parallel with a side of the wearer above, below, and/or above and below the band when worn by the wearer. At times, the inner extension and/or outer extension may extend in manner that approximates a shape of a curve of the wearer's inner or outer breast, respectively. At times, each of the support structures may further include a side extension configured to correspond to a side of the wearer when the garment is worn by the wearer. When the garment is worn, the side extension may wrap around the side of the wearer and may provide support to the portion of the weight of the breast by transferring a portion of the breast weight to the wearer's side when the wearer wears the garment.

In another embodiment, the garment includes a set of flexible structures positioned within the housing such that each flexible structure corresponds to a position extending between a center and a bottom of the wearer's breast when the garment is worn by the wearer. Each flexible structure may be configured to reposition a portion of a volume of the wearer's breast and support a portion of a weight of the wearer's respective breast when worn by the wearer. The housing may be coupled to the set of flexible structures and may be configured to house the set of flexible structures and wrap around the wearer's chest, thereby enabling the wearer to wear the garment.

BRIEF DESCRIPTION OF THE DRAWINGS

The present application is illustrated by way of example, and not limitation, in the figures of the accompanying drawings, in which.

Figure 1:
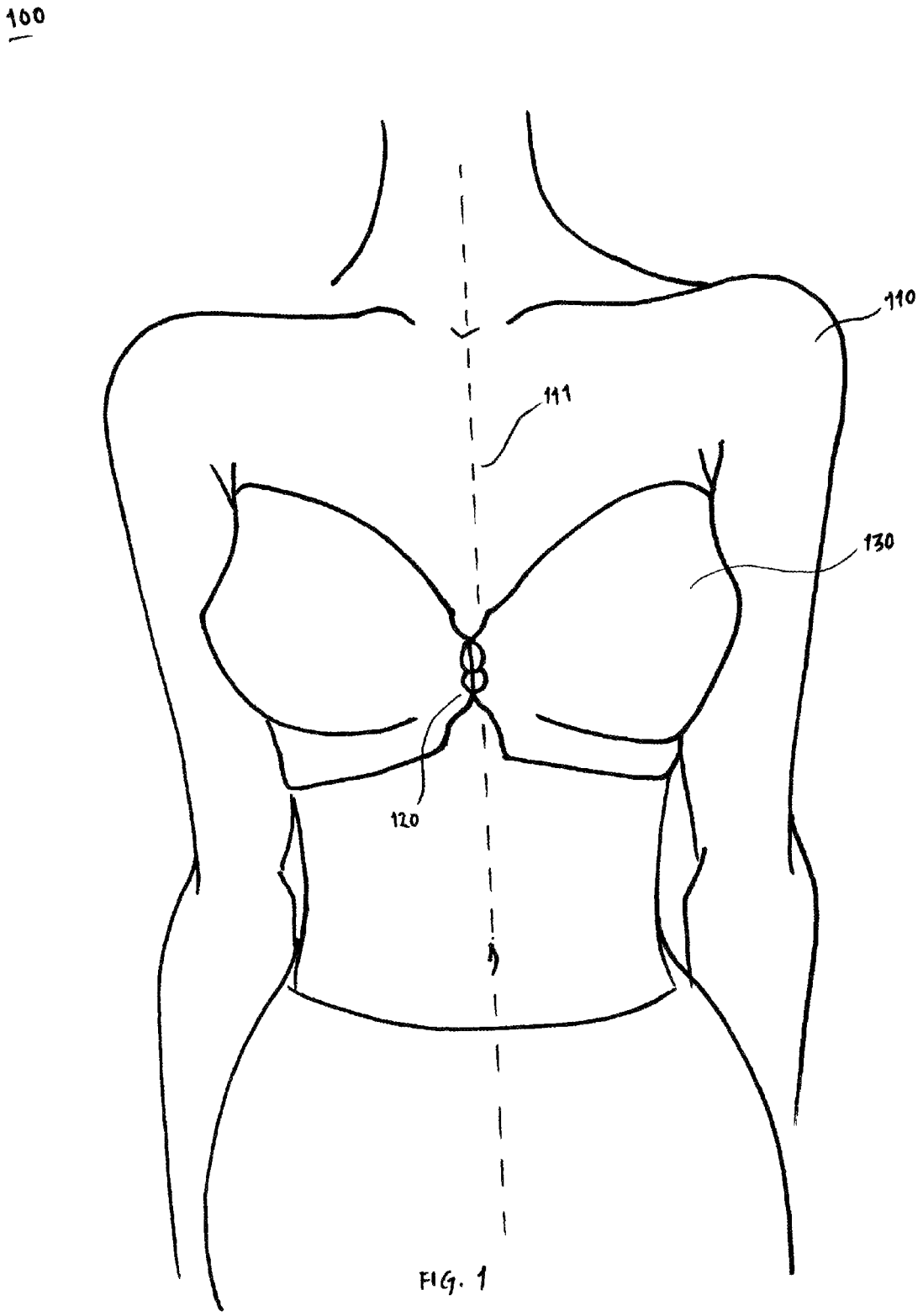
FIG. 1 depicts an exemplary support bustier garment, consistent with some embodiments of the present invention.

Throughout the drawings, the same reference numerals and characters, unless otherwise stated, are used to denote like features, elements, support structures, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

A support bustier that provides support for a wearer's breasts is herein described. Support bustier garment (as well as related support garments, such as camisoles, slips, and swimwear) simultaneously directs the volume of the breasts into an aesthetically pleasing shape, contains unwanted movement of the breasts and of the garment, and supports a natural and healthful body posture.

The support bustier garment comprises a housing that encloses and conforms to a portion of the wearer's chest. The housing may include one or more closure/adjustment mechanisms to enable a wearer to put the support bustier on (i.e., wear the support bustier), take the support bustier off (i.e., remove the support bustier), and/or adjust the fit of the support bustier. Exemplary closure/adjustment mechanisms include snaps, magnetic closures, tension closures, hook-eye closures, expandable materials (e.g., spandex and/or elastic), and tying mechanisms.

The support bustier garment further comprises one or more support structures attached to the housing. For the sake of convenience, the following discussion will refer to two support structures, one for each breast, but this is not intended to limit the scope of the invention in any way. For example, one support structure could support the weight of both breasts or four support structures (two on each side) may support each breast.

In some embodiments, the configuration the support bustier garment, the support structure, and/or the housing may be partially user configurable. For example, the tightness of the conformity of the housing to the wearer's chest may be user configurable via, for example, use of various closure mechanisms or selection of material from which the housing or support bustier garment is manufactured. In another example, the housing may coincidentally or separately accommodate attachment of a plurality of support structures. For example, a first structure may offer relatively little breast weight support. The support of this first structure may be augmented by addition of a second support structure coincidentally attached to the housing and/or the first support structure and the combination of the first and second support structures may act in combination to provide more support than the first support structure alone.

In some instances, the support structure may be removably attached to the housing so that, at times, it may be removed from the housing (e.g., prior to laundering or to enable interchanging a first support structure with a second support structure).

On occasions when the support bustier garment includes two support structures, the support structures may be manufactured in the same manner so as to be mirror symmetrical to one another or may be non-symmetrical. For example, one support structure may be a first size or manufactured to have a first set of dimensional specifications while the second support structure may be a second size or manufactured to a second set of dimensional specifications. In this way, the support bustier garment may support two different sized breasts or an artificial or prosthetic breast and a natural breast at the same time.

The support structure may be shaped and positioned to support a portion of the weight of each of the wearer's respective breasts. For example, the support structure may be positioned within the housing so as to coincide with the underside of the wearer's breasts thereby forming a weight-bearing shelf upon which a portion the weight of each respective breast rests.

The support structure may be manufactured from any acceptable material including, for example, foam, elastic, spandex, fabric, compound elastomer resins, plasticized rigid PVC compounds, polyolifin reticulated compounds, polyolefinic reticulated compounds, a resin, a closed-cell resin, an ethylene vinyl acetate (EVA) material, rubber, foam rubber, and/or some combination thereof. In some embodiments, the support structure may be constructed from a plurality of layers of, for example, the same or different materials. The layers may vary in thickness in any dimension. In some instances, the support structure and/or housing may be manufactured from a slip resistant or non-slip material. In other embodiments, the support structure and/or housing may be manufactured from an absorbent material (e.g. cotton).

Support bustier garment 100 is differentiated from traditional underwire brazier garments because the primary support structure does not lie under the breast. Instead, support bustier garment exerts forces on breast weight to support breast weight and reposition a portion of breast volume. Furthermore, support bustier garment creates a secure housing for the breasts, directing the volume of the breasts upward and forward in accordance with a fashionable silhouette, and keeping both the breasts and the garment in place during normal daily movements (e.g. standing, sitting, taking deep breaths, or eating a substantial meal), but without creating pain in the skin, ribs, muscles or other tissues surrounding the breasts. Support bustier garment also provides a smooth garment that cannot be detected under her outerwear garments. Further, support bustier garment does not create unnatural lumps, rolls, or other compression of the tissue around the edges of the garment. In addition, support bustier garment provides breast support that is supported by the endurance muscles of her "core", not the delicate stabilizing muscles of the neck and shoulders.

Turning now to FIG. 1, an exemplary support bustier garment 100 consistent with some embodiments of the invention is depicted. Support bustier garment 100 is worn by a wearer 110 having one or two breasts or artificial/prosthetic breasts. Typically, wearer 110 is a woman with one breast on each side of a midline 111 extending vertically through the center of wearer's 110 body. On some occasions, support bustier garment 100 may not include shoulder straps (i.e., strapless). On other occasions support bustier garment 100 may include straps that serve a decorative and/or functional purpose. An exterior surface of a housing 130 for support bustier garment 100 is depicted in FIG. 1. Housing 130 may serve to encase, or house, one or more components (not shown and described below) of support bustier garment 100 and facilitate the wearing of support bustier garment 100 by wearer 110. Housing 130 may be made from any acceptable material including, but not limited to, fabric, foam, elastic, spandex, LYCRA™, nylon, straps, closure mechanisms (e.g., clasps, hook-eye combinations, etc.), and some combination thereof. Housing 130 may be affixed to components of support bustier garment 100 (not shown) via any appropriate process including, but not limited to, sewing, chemical bonding, gluing, and/or heat bonding. Additionally, housing 130 may include decorative accents (e.g., printed on patterns or colors and/or affixed decorative detailing (e.g., lace, ribbon, beads, etc.)).

Optionally, wearer 110 may put on or take off support bustier garment 100 via a closure mechanism, such as a front closure mechanism 120 positioned, within housing 130 so as to approximately align with midline 111 when worn. Additionally, or alternatively, wearer 110 may put on or take off support bustier garment 100 via a rear and/or side closure mechanism (not shown) or via an expansion and/or contraction of one more materials comprising support bustier garment 100. Returning now to the closure mechanism depicted in FIG. 1, front closure mechanism 120 may include two corresponding parts that, when joined, close support bustier garment 100 around wearer 110. Likewise, when the two corresponding parts of front closure mechanism 120 are separated, wearer 110 is enabled to take off, or remove, support bustier garment 100. Front closure mechanism 110 may be affixed to support bustier garment 100 via any acceptable process including, but not limited to, sewing, chemical bonding, gluing, and/or heat bonding. On some occasions, front closure mechanism 120 may be an extension of one or more components of support bustier garment 100.

Figure 2A:
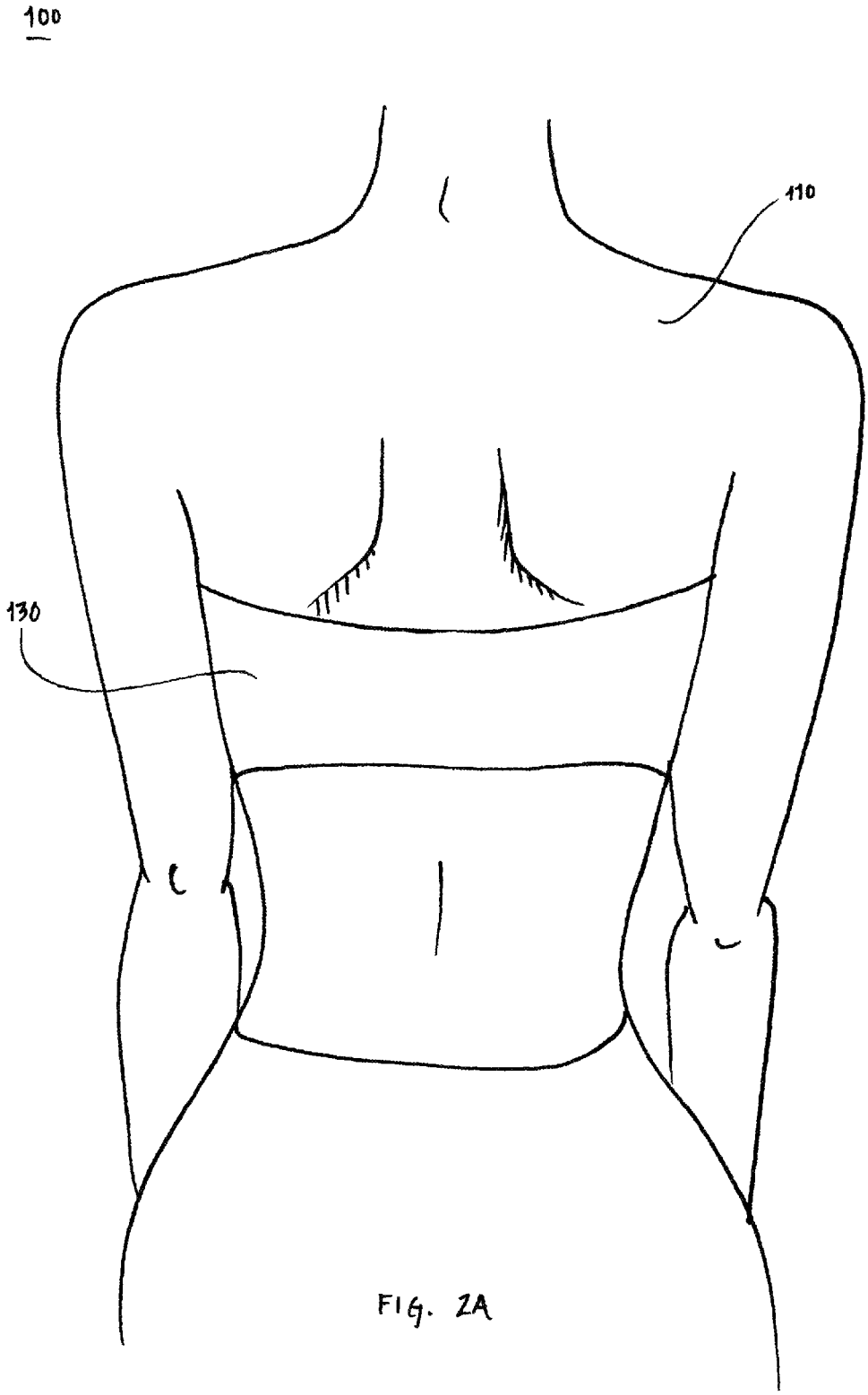
FIGS. 2A and 2B depict rear views of an exemplary support bustier garment 100, consistent with some embodiments of the present invention.

FIG. 2A depicts a rear view of an exemplary support bustier garment 100 and, more specifically, housing 130. In the embodiment of FIG. 2A, the back portion of housing 130 is a single continuous band. At times, it may be made from a flexible and/or expansive material (e.g. spandex, mesh, and/or elastic). The front and back of housing 130 may be made from a different and/or the same material(s).

Figure 2B:
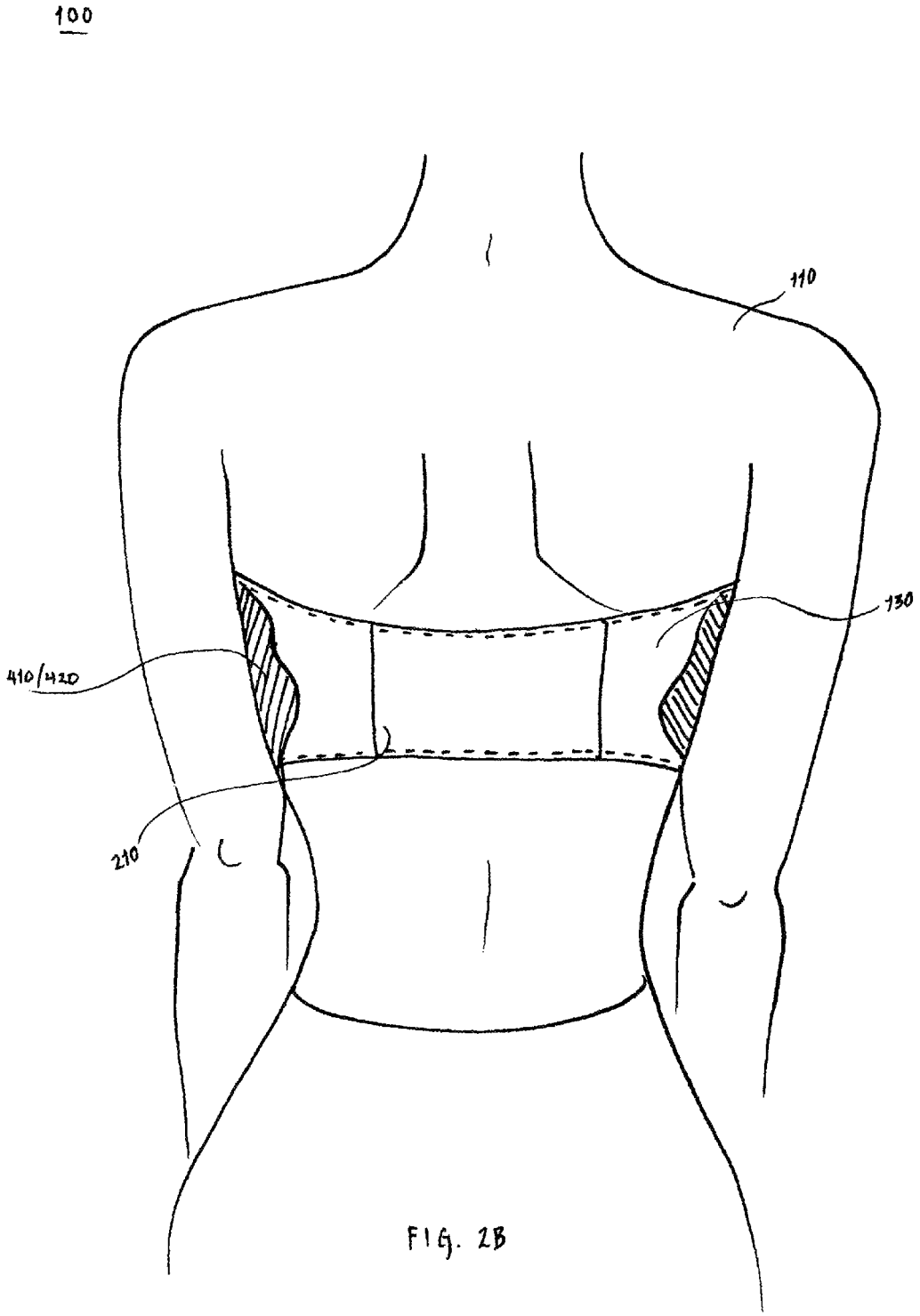

FIG. 2B depicts a rear view of an exemplary support bustier garment 100 and, more specifically, housing 130 with an exemplary rear closure mechanism 210. Rear closure mechanism 210 may be any appropriate closure mechanism (e.g., hook/eye, magnetic, tension, and/or snap closure). On some occasions, rear closure mechanism 210 may be expandable.

In the embodiment of FIG. 2B, support structure 410 and/or flexible structure 420 extend around side 115 of wearer 110. Such an extension enables support structure 410 and/or flexible structure 420 to support a portion of the weight of wearer's 110 breasts by transferring a portion of the weight of wearer's 110 breasts to wearer's side 115 and/or back.

Figure 3:
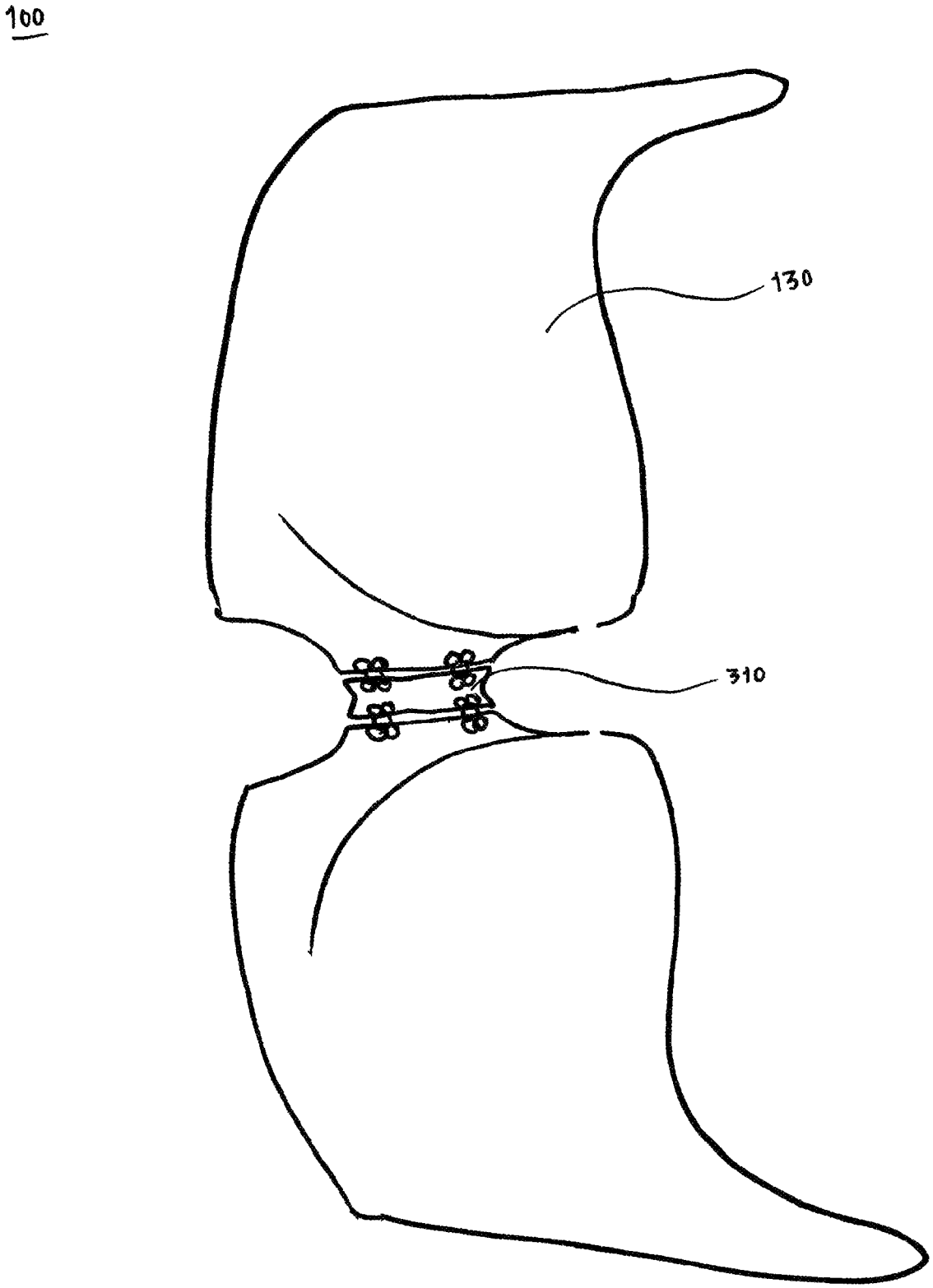
FIG. 3 depicts an exemplary closure expander for support bustier garment, consistent with some embodiments of the present invention.

FIG. 3 depicts an exemplary closure expander 310. Closure expander 310 may increase the size, or circumference, of support bustier garment 100 by expanding a distance between the corresponding parts of front closure mechanism 120 and/or rear closure mechanism 210. Closure expander 310 may be configured to cooperate with (i.e., fit into) the corresponding parts of front closure mechanism 120 and/or rear closure mechanism 210.

Figure 4:
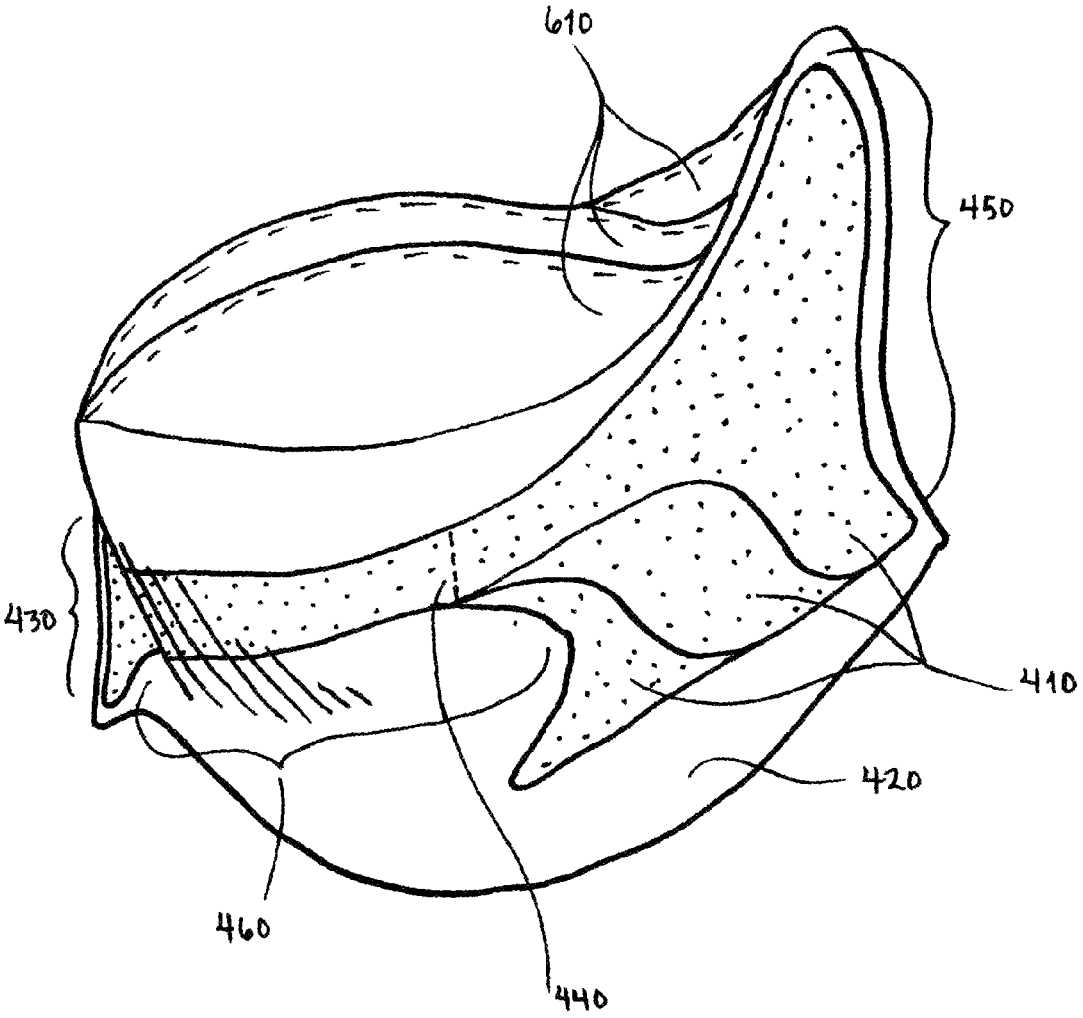
FIG. 4 depicts exemplary components of support bustier garment, consistent with some embodiments of the present invention.

FIG. 4 depicts exemplary components of support bustier garment 100 including a support structure 410 and a flexible structure 420 and a cup 610. The size and/or shape of support structure 410 may vary, as depicted in FIG. 4, according one or more design/manufacturing considerations. For example, when support structure 410 is used to support and/or reposition a relatively large amount of breast weight, support structure 410 may include all 3 variations depicted in FIG. 4. Stated differently, in the instance of supporting a relatively large amount of breast weight, support structure 410 may be larger than a support structure 410 used to support a relatively small amount of breast weight. When support structure 410 is used to support a relatively small amount of breast weight, support structure 410 may not include any extensions (i.e., outer extension 450 may only include the right-most portion depicted in FIG. 5). For embodiments where an amount of breast weight supported and/or repositioned falls between the relatively large and small amounts of this example, support structure with only the right-most and center portions may be used.

Support structure 410 may be manufactured via, for example, a molding process, a punch process, a cutting process, and/or a composite process using, for example, a single layer of a single material, multiple different materials or multiple layers of the same or different material(s). In most instances, support structures 410 will have rounded and/or tapered edges and may be manufactured and/or placed within support bustier garment 100 so as to not cause discomfort to wearer 110 (e.g., poking or chafing the skin) or extensions (e.g., bumps or ridges) beyond the surface of housing 130. Support structures 410 may be manufactured from any suitable material including, but not limited to, foam, silicon, plastic, vinyl, compound elastomer resins, plasticized rigid PVC compounds, polyolifin reticulated compounds, polyolefinic reticulated compounds, a resin, a closed-cell resin, an ethylene vinyl acetate (EVA) material, rubber, foam rubber, and/or some combination thereof.

Support structure 410 may be configured to provide support for a portion of the weight of wearer's 110 breast and, in some instances, may serve as the primary structural support, or skeleton, of support bustier garment 100. Support structure 410 and may be partially or wholly self-supporting such that is substantially retains its shape, even when not worn. The shape, composition, and placement of support structure 410 within housing 130 contribute to the achievement of this support.

Often times, support structure 410 may be shaped like a band 460 that is curved to approximate a shape of wearer's 110 breasts. Band 460 may be shaped to extend from an inner extension 430 through a center point 440 to an outer extension 450. In this way, when viewed from above, support structure 410 may have a shape approximating a "c"-like shape. Additionally, support structure 410 may be flexible enough to conform to the shape of wearer's 110 breast when worn, yet rigid enough to shape and support wearer's 110 breast.

In the embodiment depicted in FIG. 4, support structure 410 has a substantially vertically disposed outer extension 450, which may extend in a direction approximately in parallel to midline 111 (e.g., within 20 degrees of midline 111) in a direction approximating a wearer's breast, and/or in a direction approximating a torso (i.e., ribcage or chest) of a wearer. In some embodiments, outer extension 450 may extend around a side 115 and/or back of wearer 110. Outer extension 450 may be shaped and positioned so as to provide support for an outer side of wearer's 110 breasts by, for example, distributing weight from wearer's 110 breast to wearer's 110 chest and/or rib cage. Although the outer extension 450 depicted in FIG. 1 extends both above and below band 460, this may not always be the case as outer extension 450 may extend either only above or below band 460. Additionally, in some embodiments, outer extension 450 may shaped to correspond to a position partially underneath wearer's 110 breast when worn.

In the embodiment depicted in FIG. 4, support structure 410 has a vertically disposed inner extension 430, which may extend in a direction substantially in parallel midline 111 (e.g., within 20 degrees of midline 111) in a direction approximating a wearer's breast, and/or in a direction approximating a torso (i.e., sternum) of wearer 110. Inner extension 430 may be shaped and positioned so as to provide support for an inner side of wearer's 110 breasts by, for example, distributing weight from wearer's 110 breast to wearer's 110 chest and/or rib cage. Although the inner extension 430 depicted in FIG. 4 extends both above and below band 460, this may not always be the case as inner extension 450 may extend above and/or below band 460. Additionally, in some embodiments, inner extension 430 may be shaped to partially fit underneath wearer's 110 breast. On some occasions, inner extension 430 may serve as structural support for a front closure mechanism (not shown), such as front closure mechanism 120 by which wearer 110 may put on or remove support bustier garment 100.

When viewed from the front, support structure 410 may have any number of different shapes, which may be dependent upon, for example, functional, weight bearing, and/or decorative considerations. For example, the shape of support structure 410 may vary (e.g., overall size or configuration) to provide more or less support as preferred by, for example, wearer 110 and/or in accordance with support needs associated with various types of activities (e.g., athletic activities or wearing clothing exposing a portion of wearer's 110 chest as would be the case with a strapless evening gown).

In some embodiments, a shape of support structure 410 may vary in accordance with wearer's 110 breast size (e.g., cup size) or body size (e.g., chest circumference or weight), such that a support structure 410 designed to be worn by a wearer 110 with relatively large breasts may be configured differently (e.g., larger overall, larger band 460, and/or larger inner/outer extensions 450/430) than a support structure 410 for a wearer 110 with relatively small breasts.

Additionally, support structures 410 may be composed from one or more different materials depending upon, for example, functional, weight bearing, and/or decorative considerations. For example, the composition of support structure 410 may vary (e.g., overall size or configuration) to provide more or less support as preferred by, for example, wearer 110 and/or in accordance with support needs associated with various types of activities. An amount of support provided by support structure 410 may be adjusted by, for example, composing support structure 410 from materials with varying rigidity, flexibility, thickness, and/or malleability.

Further, support structures 410 may be placed within housing 130 depending upon, for example, functional, weight bearing, and/or decorative considerations. For example, the placement of support structures 410 may vary (e.g., higher or lower) to provide more or less support as preferred by, for example, wearer 110 and/or in accordance with support needs associated with various types of activities. Additionally, or alternatively, support structure 410 may be placed below the apex, or nipple, of wearer's 110 breast. Such placement may contribute to a smooth appearance (i.e., no bump or ridge) when support bustier garment 100 is worn. Support structure 410 may be resident within or on an inner or outer surface of housing 410.

The placement of support structures 410 within a housing may also vary in accordance with wearer's 110 breast size (e.g., cup size), such that a support structure 410 designed to be worn by a wearer 110 with relatively large breasts may be positioned differently (e.g., a greater proportion of support structure 410 may be placed on the underside of wearer's 110 breast) from the position of support structures 410 for a wearer 110 with relatively small breasts.

In some instances, support structures 410 may cooperate with flexible structure 420 to support a portion of the weight of wearer's 110 breasts and provide a secure comfortable fit when worn by wearer 110. Flexible structure 420 may be configured to shape the wearer's breasts (e.g., provide lift and/or separation of the breasts). Flexible structure 420, as well as support structure 410, may be manufactured from any suitable material including, but not limited to, foam, silicon, plastic, vinyl, compound elastomer resins, plasticized rigid PVC compounds, polyolifin reticulated compounds, polyolefinic reticulated compounds, a resin, a closed-cell resin, an ethylene vinyl acetate (EVA) material, rubber, foam rubber, and/or some combination thereof. Flexible structures 420 may be manufactured via, for example, a molding process, a punch process, a cutting process, and/or a composite process using multiple different materials or multiple layers of the same material. In most instances, flexible structures 420 will have rounded and/or tapered edges and may be manufactured and/or placed within support bustier garment 100 so as to not cause discomfort to wearer 110 (e.g., compressing the chest or chafing the skin).

Flexible structure 420 may extend above and/or below support structure 410. In some instances, flexible structure 420 may be one piece to which support structure 410 is affixed and/or support structure 410 may be embedded within flexible structure 420. Flexible structures 420 may be affixed to support structures 410 via any acceptable process including, but not limited to, sewing, chemical bonding, gluing, and/or heat bonding. Support structures 420 may be resident within a housing (not shown) and may, in some instances, include decorative accents (e.g., printed on patterns or colors and/or affixed decorative detailing).

Flexible structure 420 may be manufactured and/or configured so as to expand and contract with movements of wearer's 110 body (e.g., breathing, twisting, movement of the arms, bending at the waist, etc.). Flexible structure 420 may have any number of different shapes, which may be dependent upon, for example, functional, weight bearing, and/or decorative considerations. For example, the shape of flexible structures 420 may vary (e.g., overall size or configuration) to provide more or less support as preferred by, for example, wearer 110 and/or in accordance with support needs associated with various types of activities.

The shape of flexible structures 420 may also vary in accordance with wearer's 110 breast size (e.g., cup size) or body size (e.g., chest circumference or weight), such that a flexible structure 420 designed to be worn by a wearer 110 with relatively large breasts may be configured differently (e.g., larger overall) than flexible structures 420 for a wearer 110 with relatively small breasts.

Additionally, flexible structure 420 may be composed from one or more different materials depending upon, for example, functional, weight bearing, and/or decorative considerations. For example, the composition of flexible structures 420 may vary (e.g., overall size or configuration) to provide more or less support as preferred by, for example, wearer 110 and/or in accordance with support needs associated with various types of activities. An amount of support provided by flexible structure 420 may be adjusted by composing flexible structures 420 from materials with varying rigidity, flexibility, thickness, and/or malleability.

The composition of flexible structures 420 may also vary in accordance with wearer's 110 breast size (e.g., cup size), such that a flexible structure 420 designed to be worn by a wearer 110 with relatively large breasts may be composed differently (e.g., using a stronger, more rigid, or thicker material and/or multiple layers of the same and/or a different material) than flexible structures 420 for a wearer 110 with relatively small breasts.

Further, flexible structures 420 may be positioned within housing 130 to incorporate, for example, functional, weight bearing, containment, and/or decorative considerations. For example, the placement of flexible structures 420 may vary (e.g., higher or lower) to provide more or less support as preferred by, for example, wearer 110 and/or in accordance with support needs associated with various types of activities.

The size, position, shape, and/or composition of cup 610 may be dependent upon various concerns (e.g., functional, structural, decorative, and/or manufacturing). Often times, cup 610 may be made from fabric, foam, or some combination thereof. Cup 610 may be positioned on an interior or exterior surface of support structure 410 and/or flexible structure 420. In some embodiments, cup 610 may make up a portion of an interior surface of housing 130 and, when worn by wearer 110, may be directly adjacent to the surface of wearer's 110 breasts.

Cup 610 may connect a top portion of inner extension 430 with a top portion of outer extension 450. This connection may provide structure to support bustier garment 100 and assist support structure 410 and flexible structure 420 with supporting a portion of the weight and/or repositioning a portion of a volume from a wearer's breast.

Figure 5A:
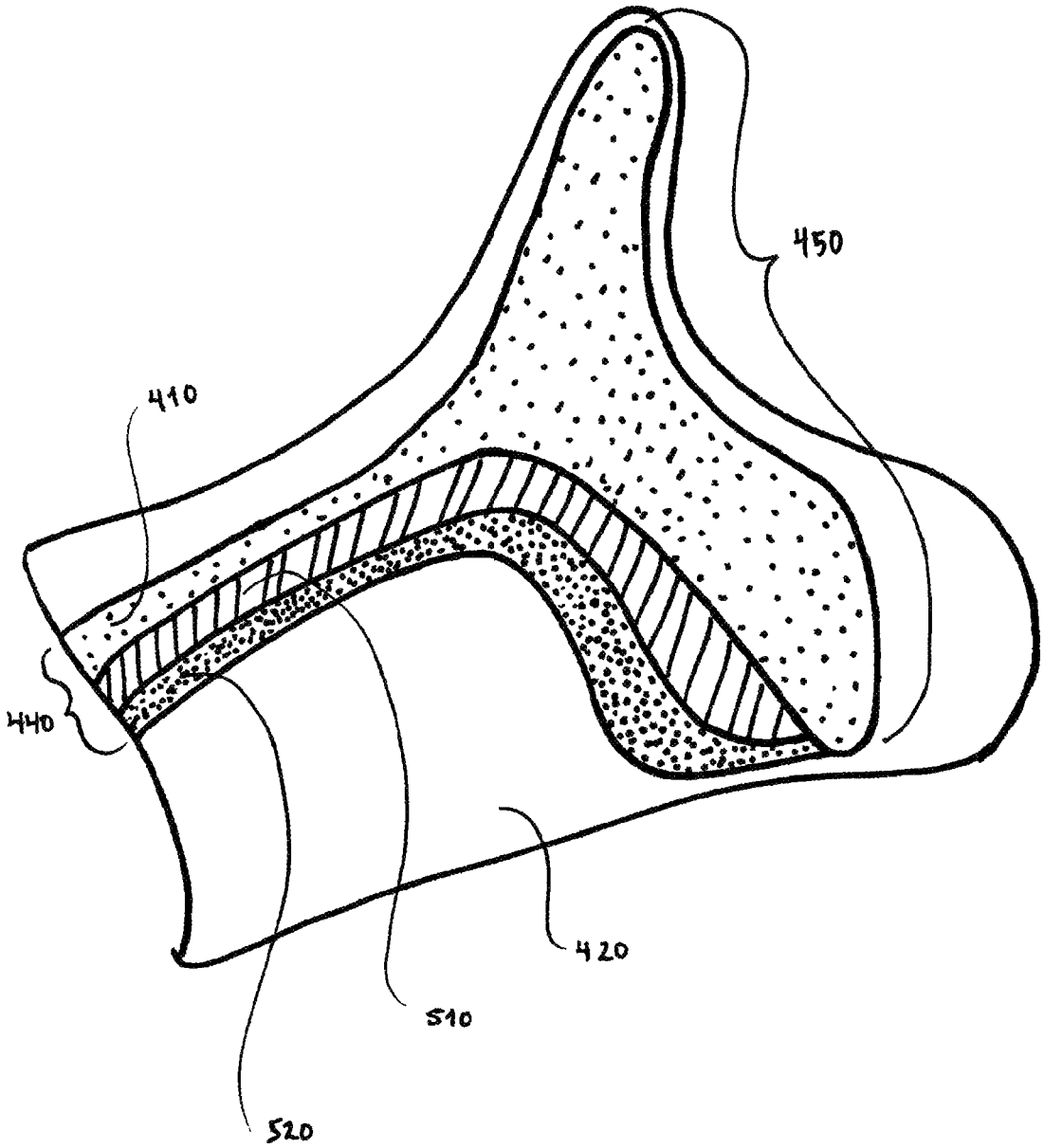
FIGS. 5A and 5B illustrate exemplary constructions of support bustier garment, consistent with some embodiments of the present invention.
Figure 5B:
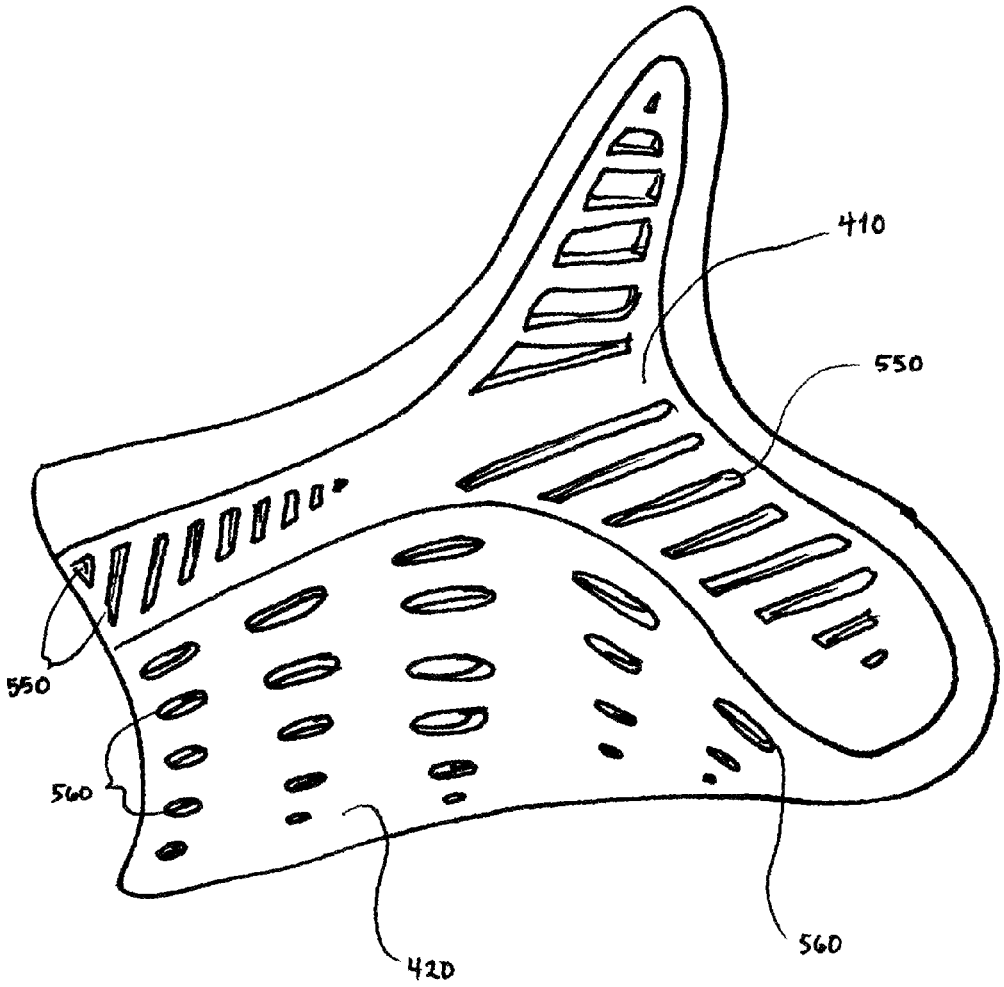

FIGS. 5A and 5B illustrate exemplary constructions of support bustier garment 100. For example, 5A illustrates two exemplary extensions 510 and 520 that may be added to support structure 410 so as to increase the size and/or support provided by support structure 410.

FIG. 5B depicts a support structure 410 with exemplary support structure 410 perforations 550 and exemplary flexible structure 420 perforations 560. Perforations 550 may be of any size or pattern and may be located at any position along support structure 410. Perforations 560 may be of any size or pattern and may be located at any position along flexible structure 420. Perforations 550/560 may serve to, for example, increase airflow between a skin surface of a wearer and the air outside the surface of the skin and, in this way, may increase the overall breathability of support bustier garment 100, allow for transference of moisture and/or body heat from a surface of a wearer's skin. Additionally, or alternatively, perforations 550 may serve to increase the flexibility and/or decrease the weight of support structure 410 and/or support bustier garment 100.

Perforations 550/560 may be formed via a cutting, punching, and/or molding process. Additionally or alternatively, support structure 410 may be fabricated in such a way that perforations 550 are inherent to the fabrication process. Further, in some embodiments, perforations 550 may only partially extend through support structure 410 so that a portion (although in most instances a thinner portion) of support structure 410 remains in the perforated region(s).

Figure 6A:
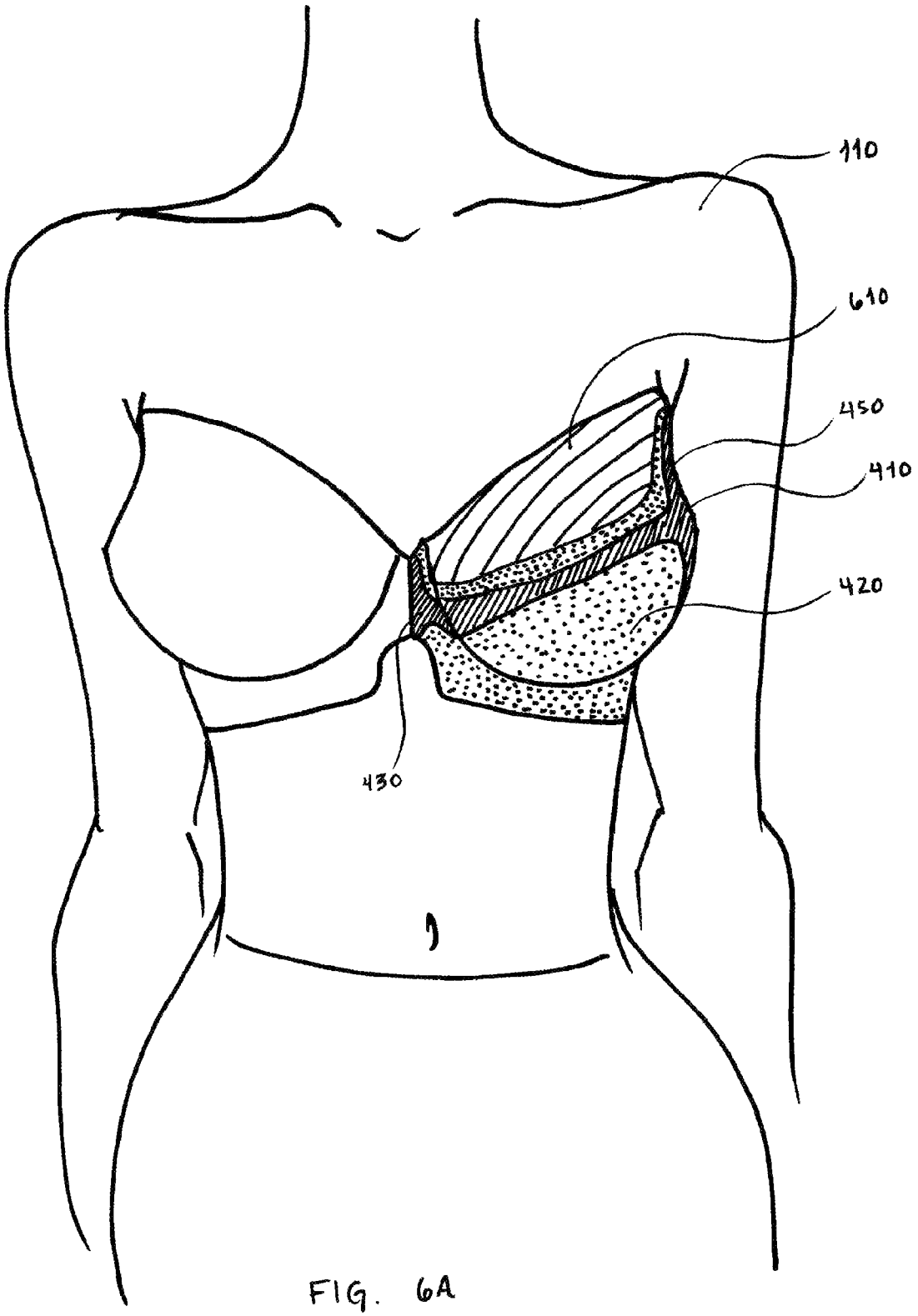
FIG. 6A depicts front view of several components of support bustier garment, consistent with some embodiments of the present invention.

FIG. 6A depicts a front view of several components of support bustier garment 100, including support structure 410, flexible structure 420, and a cup 610.

Figure 6B:
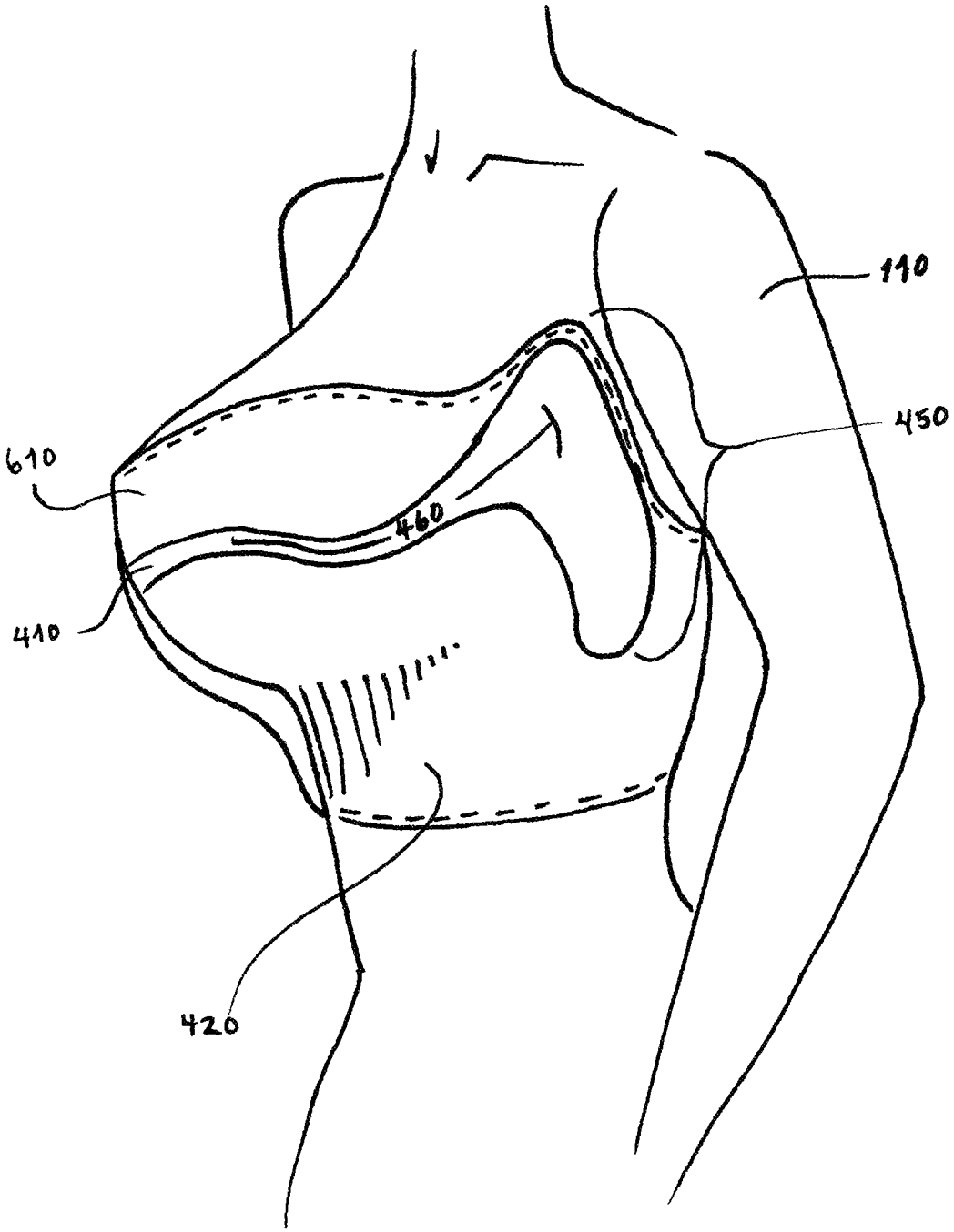
FIG. 6B depicts a side view of several components of support bustier garment, consistent with some embodiments of the present invention.

FIG. 6B depicts a side view of several components of support bustier garment 100, including support structure 410, flexible structure 420, and cup 610. As can bee seen in FIG. 6B, outer extension 450 extends above and below band 460 in a manner that is substantially parallel with side 115 of wearer 110. Substantially parallel in this instance is plus or minus 20 degrees from a vertical meridian extending from the shoulder to the hip of wearer 110. At times, outer extension 450 may be shaped so as to approximate a shape of an outer curve of wearer's 110 breast. On some occasions, outer extension 450 may be fabricated using dimensional specifications specific wearer 100. On other occasions, outer extension 450 may be fabricated using dimensional specifications generalized to a group of wearers 100 sharing one or more characteristics (e.g., cup size, weight, chest circumference, etc.).

Figure 7A:
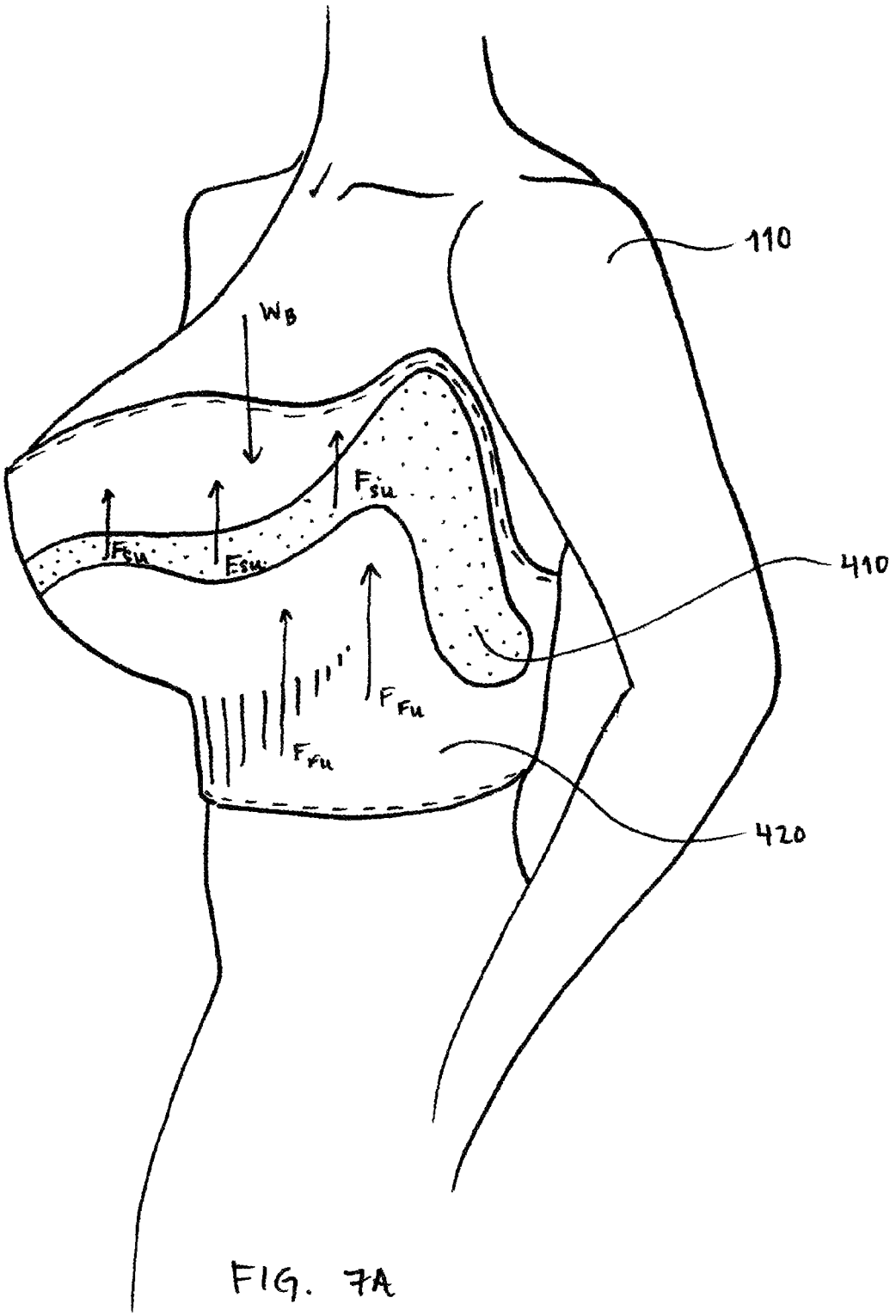
FIGS. 7A and 7B depict side views of several components of support bustier garment, consistent with some embodiments of the present invention.
Figure 7B:
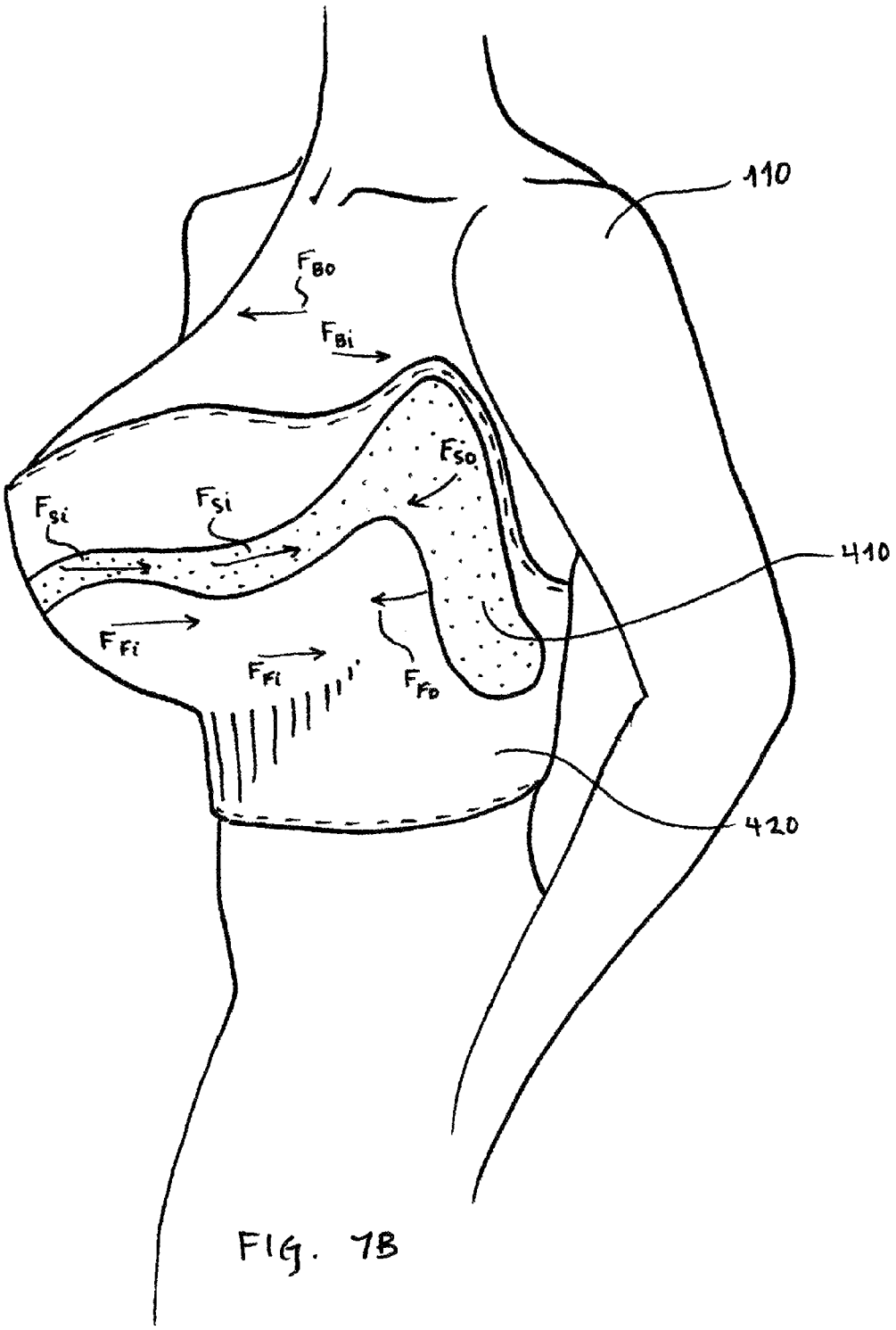

FIG. 7A depicts a side view of several components of support bustier garment 100, including support structure 410 and flexible structure 420 and the upward forces the support structure 410 and flexible structure 420 exert on wearer's 110 breast. Wearer's 110 breast has a weight, or force down, $W_B$. Support structure 410 and/or flexible structure 420 of support bustier garment 100 exert upward force(s) $F_{su}$ and/or $F_{fu}$ opposing $W_B$ or a portion thereof when worn by wearer 110.

It is important to note that, in most cases, support structure 410 and/or flexible structure 420 of support bustier garment 100 exert force(s) $F_{su}$ and/or $F_{fu}$ independently of housing 130 (not shown). In some embodiments, support structure 410 and/or flexible structure 420 may form a shelf upon which breast weight $W_B$ or a portion thereof rests upon the shelf, which provides upward support to weight of breast. On some occasions, force(s) $F_{su}$ and/or $F_f$ may also act to reposition a portion of the volume of wearer's 110 breasts. Such repositioning may include pushing a portion of the breast volume up, toward the midline, provide a more uniformly round appearance to wearer's 110 breast.

In some instances, an extended underside 810 of support bustier garment 100 may extend down a chest of wearer 110 as depicted in FIG. 8. Extended underside 810 may be made from, for example, housing 130 and/or flexible structure 420. In some instances, extended underside 810 may include additional support structures similar to support structures 410 (not shown). These additional support structures may be vertically and/or horizontally oriented and may serve to support breast weight and/or shape the torso of wearer 110.

FIG. 7AB depicts a side view of several components of support bustier garment 100, including support structure 410 and flexible structure 420 and the forces the support structure 410 and flexible structure 420 exert on wearer's 110 breast toward the inside of wearer's 110 torso and toward the outside of wearer's 110 torso. A portion of the volume of wearer's 110 breast exerts a force outward as it extends outward from the torso $F_{BO}$ and force that resists compression of the breast $F_{BI}$.

Support structure 410 and/or flexible structure 420 of support bustier garment 100 exert outward force(s) $F_{so}$ and/or $F_{fo}$ that oppose $F_{BI}$ to reposition a portion of the volume of the breast outward from the torso of wearer 110. Support structure 410 and/or flexible structure 420 of support bustier garment 100 also exert inward force(s) $F_{sI}$ and/or $F_{FI}$ that oppose $F_{BO}$ to reposition a portion of the volume of the breast in toward the torso of wearer 110.

It is important to note that, in most cases, support structure 410 and/or flexible structure 420 of support bustier garment 100 exert force(s) $F_{so}$, $F_{fo}$, $F_{fi}$ and/or $F_{fi}$ independently of housing 130 (not shown).

Figure 8A:
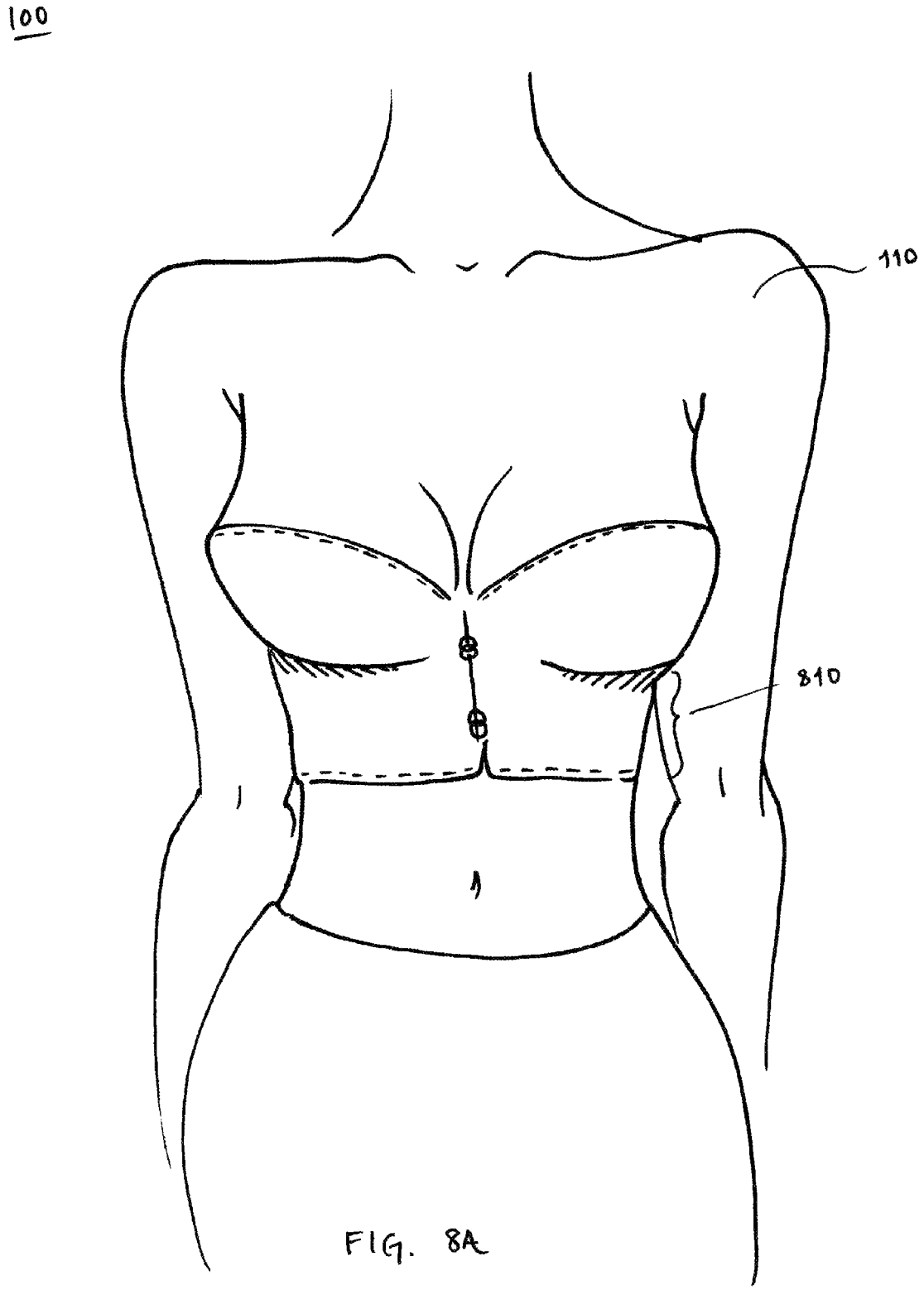
FIGS. 8A and 8B depict extended undersides of support bustier garment, consistent with some embodiments of the present invention.
Figure 8B:
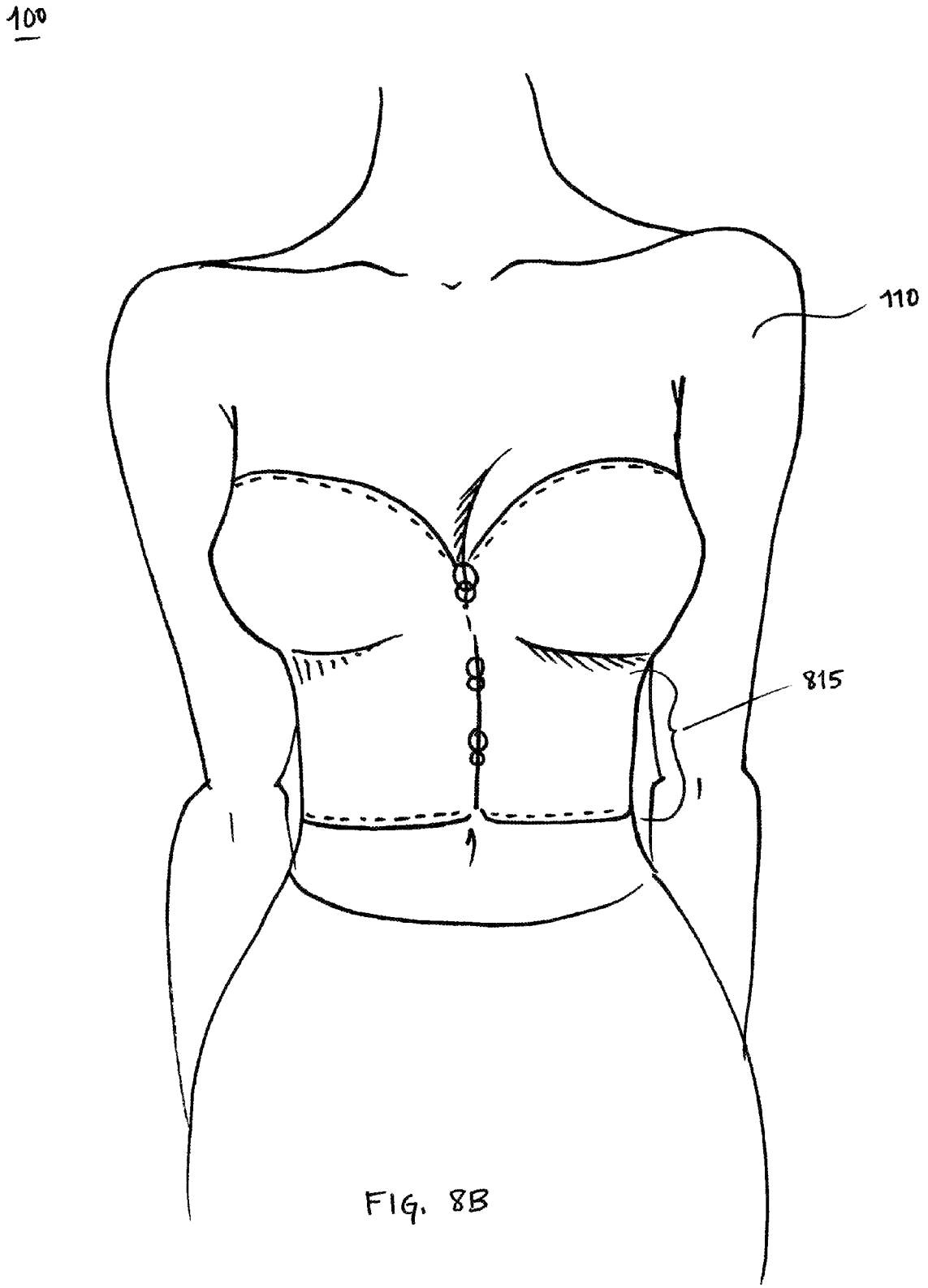

In some instances, extended underside 810 or 815 of support bustier garment 100 may extend down a chest of wearer 110 as depicted in FIGS. 8A and 8B, respectively. Extended undersides 810 and/or 815 may be made from, for example, housing 130 and/or flexible structure 420. In some instances, extended undersides 810 and/or 815 may include additional support structures similar to support structures 410 (not shown). These additional support structures may be vertically and/or horizontally oriented and may serve to support breast weight and/or shape the torso of wearer 110.

Figure 9:
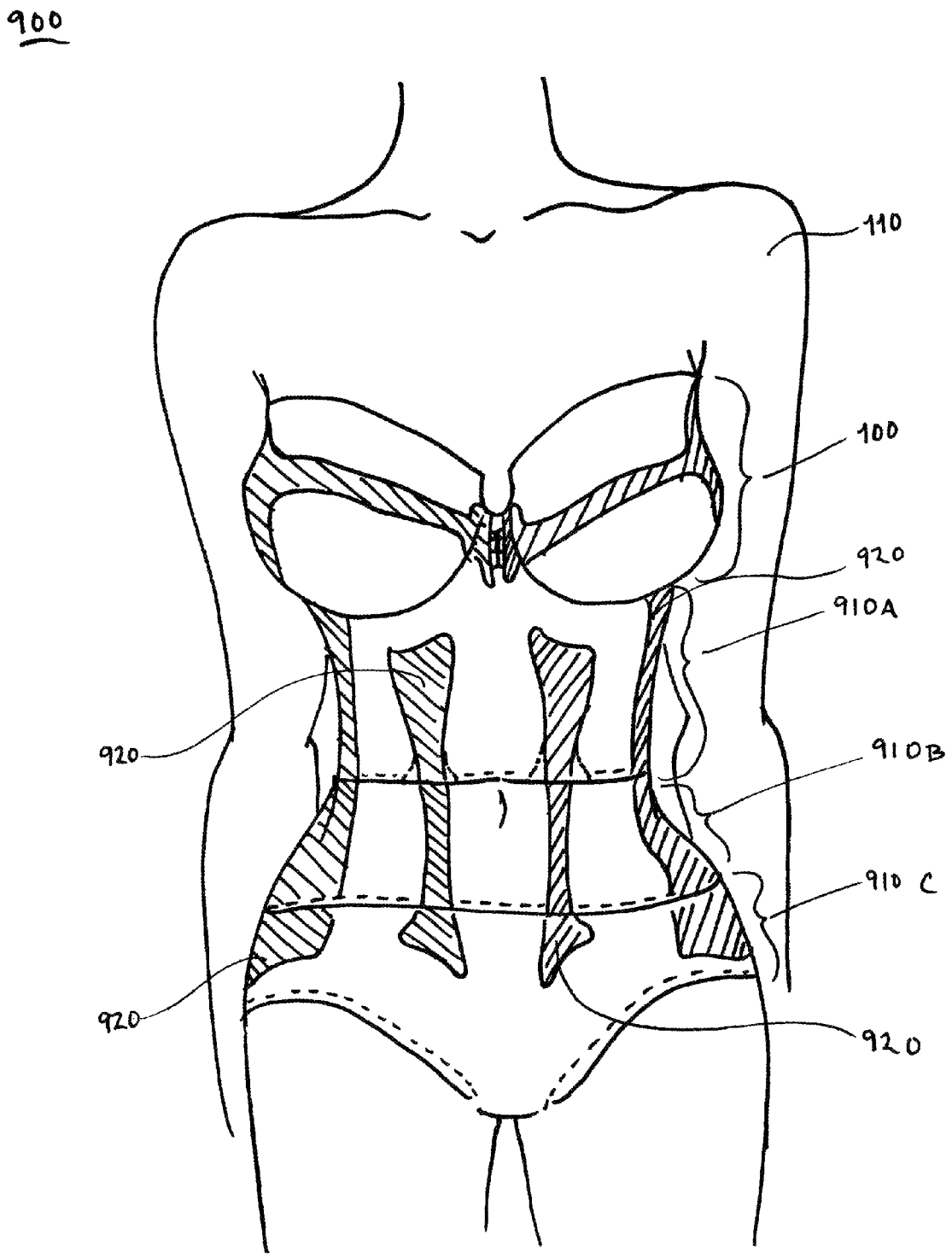
FIG. 9 depicts a body support garment 900, consistent with some embodiments of the present invention.

FIG. 9 depicts a body support garment 900 that includes a support bustier garment 100 as well as optional torso support garments 910A, 910B, and 910C. Torso support garments 910A, 910B, and 910C may extend from and/or be attached to support bustier garment 100 and be of variable lengths, such that torso support garment 910A extends from under wearer's 110 breasts to an approximate position of wearer's 110 waist, torso support garment 910B extends from an approximate position of wearer's 110 waist to an approximate position of wearer's 110 hips, and torso support garment 910B extends from the approximate position of wearer's 110 hips to an approximate position of wearer's 110 upper leg. In some embodiments, body support garment 900 may include gaps or other features (not shown) that may enable free movement of wearer 110.

Body support garment 900 may be configured to include support bustier garment 100 as well as torso support garment 910A, support bustier garment 100 as well as torso support garments 910A and 910B, and support bustier garment 100 as well as torso support garments 910A, 910B, and 910C. In some instances, support bustier garment 100 and torso support garments 910A, 910B, and/or 910C may be detachable and/or sold separately and assembled by wearer 110 prior to being worn. Wearer 110 may put on/take off support bustier garment 100 and torso support garments 910A, 910B, and/or 910C via, for example, a front and/or rear closure mechanism not shown), such as front and/or rear closure mechanisms 120 or 210.

Torso support garments 910A, 910B, and/or 910C may include one or more torso support structures 920, which may be composed of a material similar to the material used to manufacture support structure 410 and/or flexible structure 420. Torso support structures 920 may be positioned so as to support and/or shape the torso, or portions thereof, of wearer 110. Such support may be provided for a myriad of considerations including, but not limited to, physical and/or structural support or the torso, shaping of the torso into a shape desired by wearer 110 (e.g., form a narrower circumference of the torso at the waist than at the chest and/or hips), or to decorative accents to a garment. In some embodiments, one or more of torso support garments 910A, 910B, and/or 910C may be incorporated into swimwear, slips, and/or clothing.

Figure 10A:
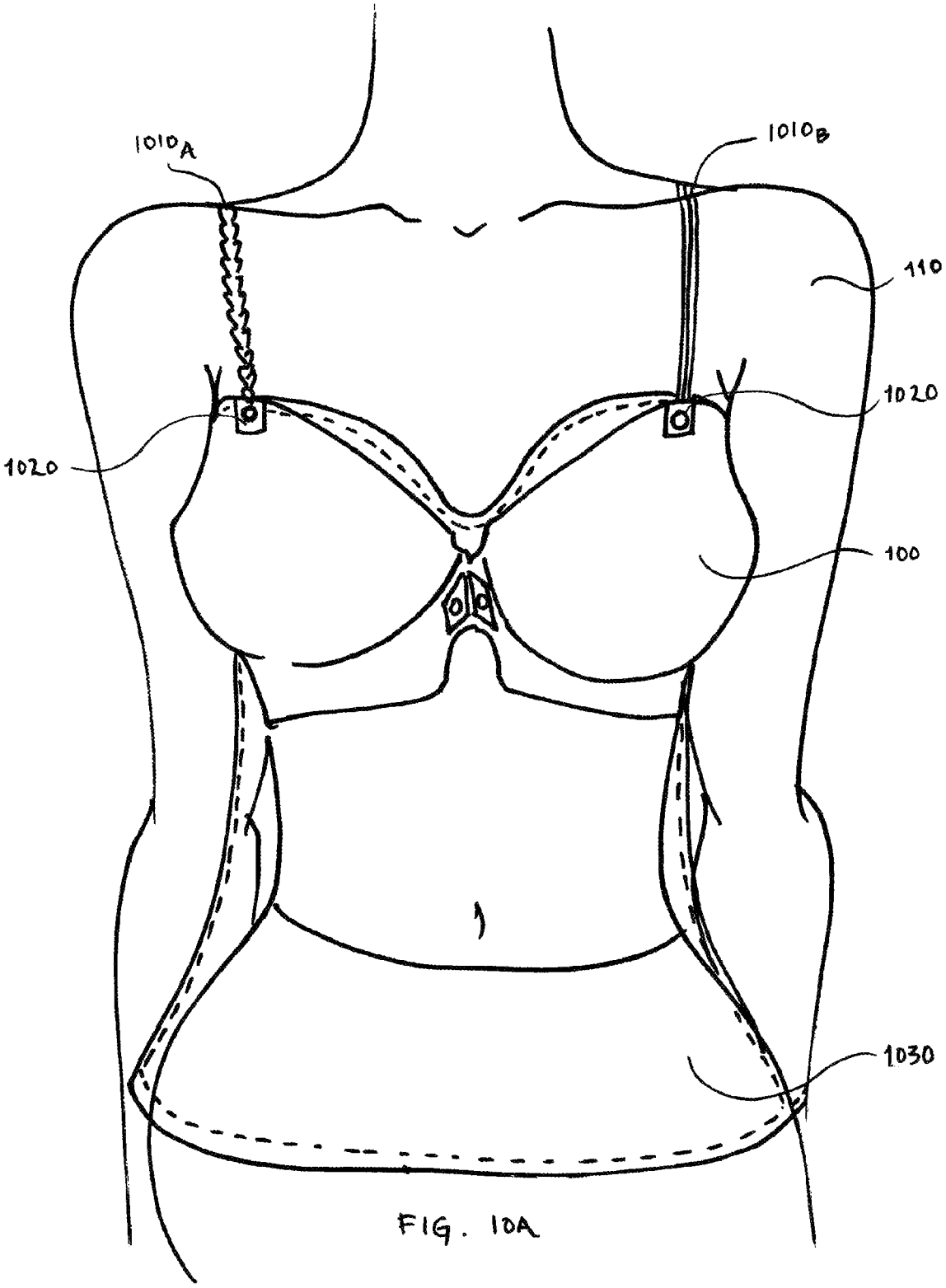
FIGS. 10A and 10B depict front and rear views of optional embellishments for support bustier garment, consistent with some embodiments of the present invention.
Figure 10B:
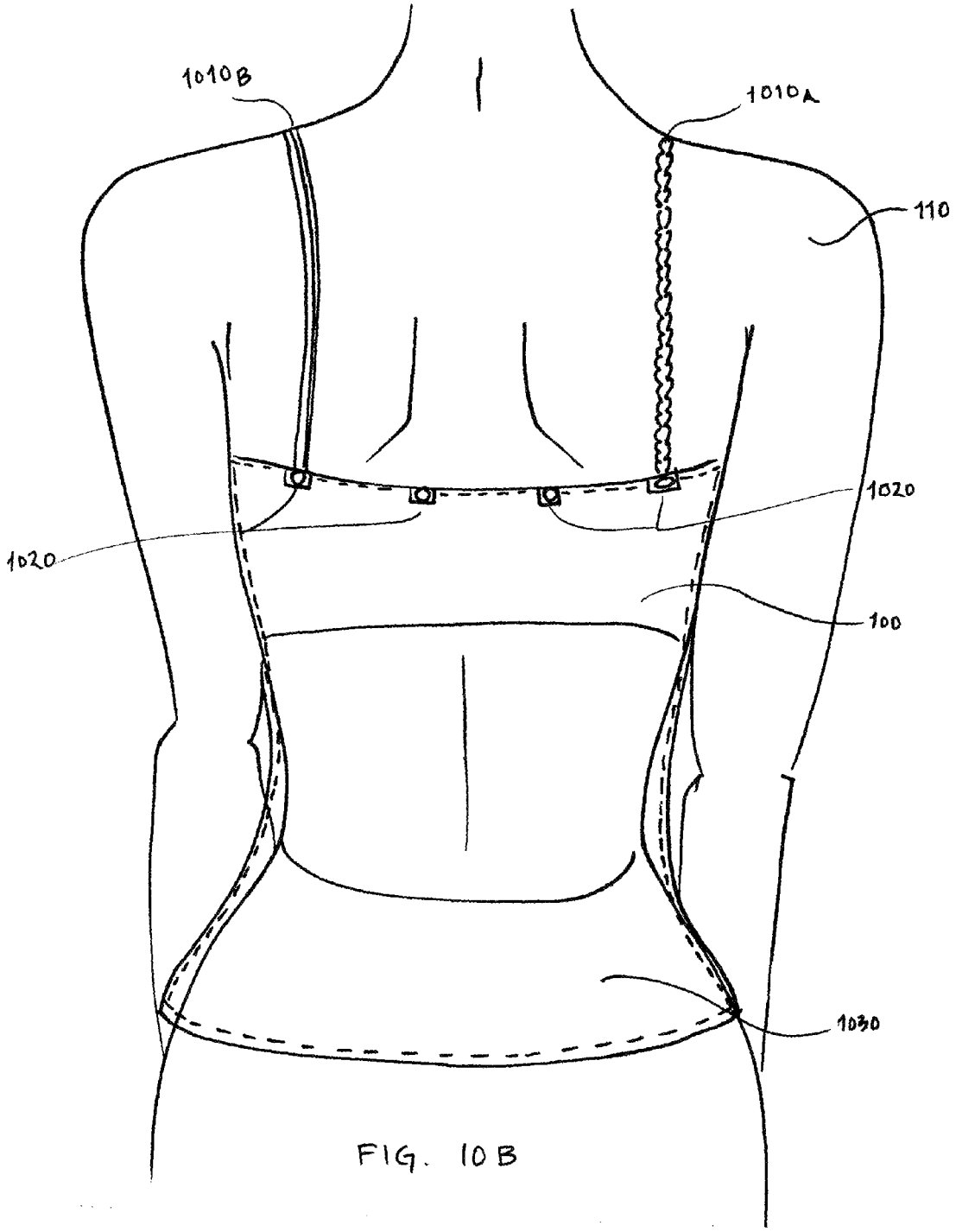

FIGS. 10A and 10B depict a front and rear view optional embellishments or add-ons for support bustier garment 100 respectively. Exemplary embellishments include a camisole attachment 1030 and strap attachments 1010A and 10108, which may be attached, removably or otherwise, to support bustier garment 100 via an attachment mechanism 1020, such as a magnet, snap, tension closure and/or hook/eye. Additionally, or alternatively, camisole attachment 1030 and/or strap attachments 1010A and 10108 may be attached via sewing, gluing, or bonding.

Strap attachments 1010A and 10108 may serve a decorative and/or functional (e.g., holding up support bustier garment 100) and may be interchanged according to a wearer's preference. Strap attachments 1010A and 10108 may be manufactured from a variety of materials, such as fabric, elastic, ribbon, lace, silicon, and/or some combination thereof.

Camisole attachment 1030 may serve a decorative and/or functional (e.g., covering wearer's 110 torso and/or support bustier garment 100) and may be interchanged according to a wearer's preference. Camisole attachment 1030 may be manufactured from a variety of materials, such as fabric or leather.

Additional embellishments and/or embodiments for support bustier garment 100 include slips and swimwear. Swimwear may include two-piece or one-piece swimming attire.

Hence, support bustier garment that reposition a portion of a volume of the wearer's respective breast and support a portion of a weight of the wearer's respective breast when worn by the wearer have been herein described.

I claim:

1. A bustier garment comprising:

a first support structure, the first support structure being positioned within a housing such that the first support structure corresponds to a position between a center and a bottom of a wearer's first breast when the bustier garment is worn by a wearer, the first support structure including a first side extension configured to correspond to a first side of a wearer's chest when the bustier garment is worn by the wearer, the first side of the wearer's chest not including the wearer's first breast;

a second support structure, the second support structure being positioned within the housing such that the second support structure corresponds to a position between a center and a bottom of a wearer's second breast when the bustier garment is worn by the wearer, the second support structure including a second side extension configured to correspond to a second side of a wearer's chest when the bustier garment is worn by the wearer, the second side of the wearer's chest not including the wearer's second breast; and the housing, the housing being configured to house the first and second support structures and wrap around the wearer's chest, thereby enabling the wearer to wear the bustier garment.

2. The bustier garment of claim 1, wherein the housing includes a closure mechanism positioned between the first and second support structures.

3. The bustier garment of claim 1, wherein the first and second support structures comprise multiple pieces.

4. The bustier garment of claim 1, wherein the first and second support structures are contoured to accommodate a positioning of the wearer's first and second respective breasts therein when the garment is worn by the wearer.

5. The bustier garment of claim 1, wherein the first and second support structures retain their shape independently of the housing.

6. The bustier garment of claim 1, the first and second support structures further comprising:

one or more perforations.

7. The bustier garment of claim 1, the housing further comprising:

a plurality of attachment mechanisms configured to removably attach to one or more embellishments to the garment.

8. The bustier garment of claim 1, each of the first and second support structures further comprising:

an outer extension, the outer extension being positioned on an edge of the respective support structure furthest away from a vertical midline of the garment and extending in a direction substantially perpendicular to the respective first and second support structures.

9. A bustier garment comprising:

a first support structure, the first support structure being positioned and oriented within a first breast cup portion of a housing such that the first support structure is substantially perpendicular to a vertical midline of the garment, wherein a portion of the first support structure extends beyond the first breast cup portion of the housing in a direction substantially perpendicular to the vertical midline of the garment;

a second support structure, the second support structure being positioned and oriented within a second breast cup portion of the housing such that the second support structure is substantially perpendicular to the vertical midline of the garment, wherein a portion of the second support structure extends beyond the second breast cup portion of the housing in a direction substantially perpendicular to the vertical midline of the garment; and the housing, the housing being configured to house the first and second support structures.

10. The bustier garment of claim 9, wherein the first support structure includes a first extension that is substantially perpendicular to the first support structure and the second support structure includes a second extension that is substantially perpendicular to the second support structure.

11. The bustier garment of claim 9, wherein the housing includes a closure mechanism positioned between the first and second support structures.

12. The bustier garment of claim 9, wherein at least one of the first support structure and the second support structure comprise multiple pieces.

13. The bustier garment of claim 9, wherein the first support structure and the second support structure are contoured to accommodate a positioning of a wearer's breast therein.

14. The bustier garment of claim 9, wherein the first and second support structures retain their shape independently of the housing.

15. The bustier garment of claim 9, the first and second support structures further comprising:

one or more perforations.

16. The bustier garment of claim 9, the first and second support structures further comprising:

a outer extension, the outer extension being positioned on an edge of the respective support structure furthest away from a vertical midline of the garment and extending in a direction substantially perpendicular to the respective support structure.

17. A bustier garment comprising:

a first support structure, the first support structure being positioned and oriented within a first breast cup portion of a housing such that the first support structure is substantially parallel to a lower edge of the garment, wherein a portion of the first support structure extends beyond the first breast cup portion of the housing in a direction substantially perpendicular to the vertical midline of the garment;

a second support structure, the second support structure being positioned and oriented within a second breast cup portion of the housing such that the second support structure is substantially parallel to a lower edge of the garment, wherein a portion of the second support structure extends beyond the second breast cup portion of the housing in a direction substantially perpendicular to the vertical midline of the garment; and the housing, the housing being configured to house the first and second support structures.

18. The bustier garment of claim 17, wherein the first support structure includes a first extension that is substantially perpendicular to the first support structure and the second support structure includes a second extension that is substantially perpendicular to the second support structure.

19. The bustier garment of claim 17, wherein the housing includes a closure mechanism positioned between the first and second support structures.

20. The bustier garment of claim 17, wherein at least one of the first support structure and the second support structure comprise multiple pieces.

21. The bustier garment of claim 17, wherein the first support structure and the second support structure are contoured to accommodate a positioning of a wearer's breast therein.

22. The bustier garment of claim 17, wherein the first and second support structures retain their shape independently of the housing.

23. The bustier garment of claim 17, each of the support structures further comprising:

one or more perforations.

24. The bustier garment of claim 1, wherein the first support structure is coupled to the second support structure.

25. The bustier garment of claim 9, wherein the first support structure is coupled to the second support structure.

26. The bustier garment of claim 17, wherein the first support structure is coupled to the second support structure.

* * * * *